US005090064A

United States Patent [19]

Breitenberger

[11] Patent Number: 5,090,064

[45] Date of Patent: Feb. 25, 1992

[54] INSTALLATION MODULE FOR SANITARY EQUIPMENT

[75] Inventor: Konrad Breitenberger, Weilheim, Fed. Rep. of Germany

[73] Assignee: Geberit AG, Rapperwil, Switzerland

[21] Appl. No.: 598,207

[22] Filed: Oct. 16, 1990

[30] Foreign Application Priority Data

Oct. 24, 1989 [EP] European Pat. Off. ..... 89119778.2

[51] Int. Cl.[5] ..... E03D 1/012; E03D 11/00

[52] U.S. Cl. ..... 4/252 R; 4/419; 4/661

[58] Field of Search ..... 4/252 R, 661, 416, 419, 4/DIG. 18; 52/34, 79.1, 309.9, 309.11, 220, 221; 285/64; 220/401, 444, 902

[56] References Cited

U.S. PATENT DOCUMENTS

| | | | |
|---|---|---|---|
| 2,930,505 | 3/1960 | Meyer | 4/661 |
| 3,129,437 | 4/1964 | McClenahan | 4/252 R |
| 3,210,141 | 10/1965 | Thomas | 4/661 |
| 3,251,073 | 5/1966 | Rawson | 4/252 R |
| 3,495,283 | 2/1970 | Studer | 4/252 R |
| 3,707,165 | 12/1972 | Stahl | 52/34 |
| 3,932,899 | 1/1976 | Brady et al. | 4/252 R |

FOREIGN PATENT DOCUMENTS

| | | | |
|---|---|---|---|
| 0201768 | 11/1986 | European Pat. Off. | 4/252 R |
| 3410499 | 8/1985 | Fed. Rep. of Germany | 4/252 R |
| 3617617 | 11/1987 | Fed. Rep. of Germany | 4/252 R |
| 0439327 | 9/1948 | Italy | 4/416 |

*Primary Examiner*—William A. Cuchlinski, Jr.
*Assistant Examiner*—John L. Beres
*Attorney, Agent, or Firm*—Dellett, Smith-Hill and Bedell

[57] ABSTRACT

An installation module for sanitary equipment, comprising a foamed support structure in which the elements needed for supply to and discharge from the sanitary equipment are embedded, comprising fastening connections for suspension or erection of the support structure, on the one hand, and for hooking up the sanitary equipment, on the other hand. The support structure is joined of plugged longitudinal and transverse profiled sections held together by the foamed material, preferably of two lateral sectional supports (1) defining the sides of the installation module and being interconnected by a transverse profiled section (2) inserted in the bottom area of the installation module. With their profiling and incorporated recesses/slits, the sectional supports plugged together present a substantially stiff-angled carrier structure.

15 Claims, 3 Drawing Sheets

INSTALLATION MODULE FOR SANITARY EQUIPMENT

FIELD OF THE INVENTION

The invention relates to an installation module for sanitary equipment, comprising a foamed support structure in which the elements needed for supply to and discharge from the sanitary equipment are embedded, comprising fastening connections for suspension or erection of the support structure and for attaching the sanitary equipment.

BACKGROUND OF THE INVENTION

Such an installation module as distributed by the applicant's assignee, for instance, consists of a foamed block (e.g. of polyester foamed concrete) in which are embedded elements, such as pipings and fittings, that are needed for supply to and discharge from the sanitary equipment (water closet, washbowl, etc.). Fastening connections are included in the foamed block for mounting it on a wall or for free upright placement of the foamed block. The supporting forces are transmitted into the foamed material by plate members bonded to the fastening connections. Similar fastening connections are included in the foamed material for suspending the respective sanitary equipment. The edges of the module may be protected from becoming damaged by metallic edge sections included in the foamed material. It is known as well to enclose the entire foamed block with a metallic border frame.

Prior to foaming, all the parts to be incorporated in the foamed material must be suitably positioned in the foaming mold. This is time consuming and requires secondary structures to ensure the desired coordination amongst the parts. Different positioning means are needed for different combinations of parts included in the modules and for different sizes of the modules.

Supporting forces introduced via the fastening connections must be accommodated and transmitted by the foamed material. As these forces may reach considerable levels, e.g. in case of a water closet suspended from a wall, the material employed must meet high strength requirements.

SUMMARY OF THE INVENTION

It is an object of the invention to provide a foamed installation module for sanitary equipment whose manufacture is simplified, in particular if installation modules must be produced for different build-in situations. It is another object of the invention to provide an installation module of improved stability, preferably without any specific quality requirements regarding the foamed material.

An installation module according to the invention comprises a support structure composed of plugged longitudinal and transverse profiled sections, preferably of two lateral sectional supports defining the sides of the installation module and interconnected by at least one transverse profiled section which is inserted in the bottom range of the installation module. The term "plugged" as applied to two profiled sections means that the sections are fitted together by inserting one of the profiled sections in an aperture formed in the other section. Thanks to suitable profiling and incorporated recesses or slits, the plugged longitudinal and vertical profiled sections are held against substantial relative angular movement, their cohesion being guaranteed by the foamed material. The necessary fastening connections are provided at these longitudinal and transverse profiled sections, and the forces introduced are transmitted by this sectional frame. The foamed material, on the other hand, essentially has a mere function of holding together the parts so that the requirements in respect of strength which this material must answer can be much less severe than before.

The longitudinal profiled sections give the installation module protection along the edges and stiffness against distortion, especially so if they are embodied by two lateral sectional supports defining the sides of the installation module.

The design according to the invention permits installation modules of different sizes to be produced simply by cutting the longitudinal and transverse profiled sections to corresponding lengths. The assembling is done quickly and without any difficulty by inserting the butt crosscut ends of the transverse profiled section in recesses or slits of the two longitudinal profiled sections. The necessary fastening connections are made convenient, such as by punching out at the longitudinal and transverse profiled sections. Further punch-outs serve for positioning of the respective complements (pipings, fittings, and the like). The sectional frame thus plugged and equipped then is filled with foam conveniently, making use of a foaming mold.

For reasons of strength, it is preferred to use metal sections e.g. of bent band material for the longitudinal and transverse profiled sections. If strength requirements are low, profiled sections of plastics may be used.

BRIEF DESCRIPTION OF THE DRAWING

The invention will be described further, by way of example, with reference to the accompanying drawings, in which.

DESCRIPTION OF THE PREFERRED EMBODIMENT

Figure 1:
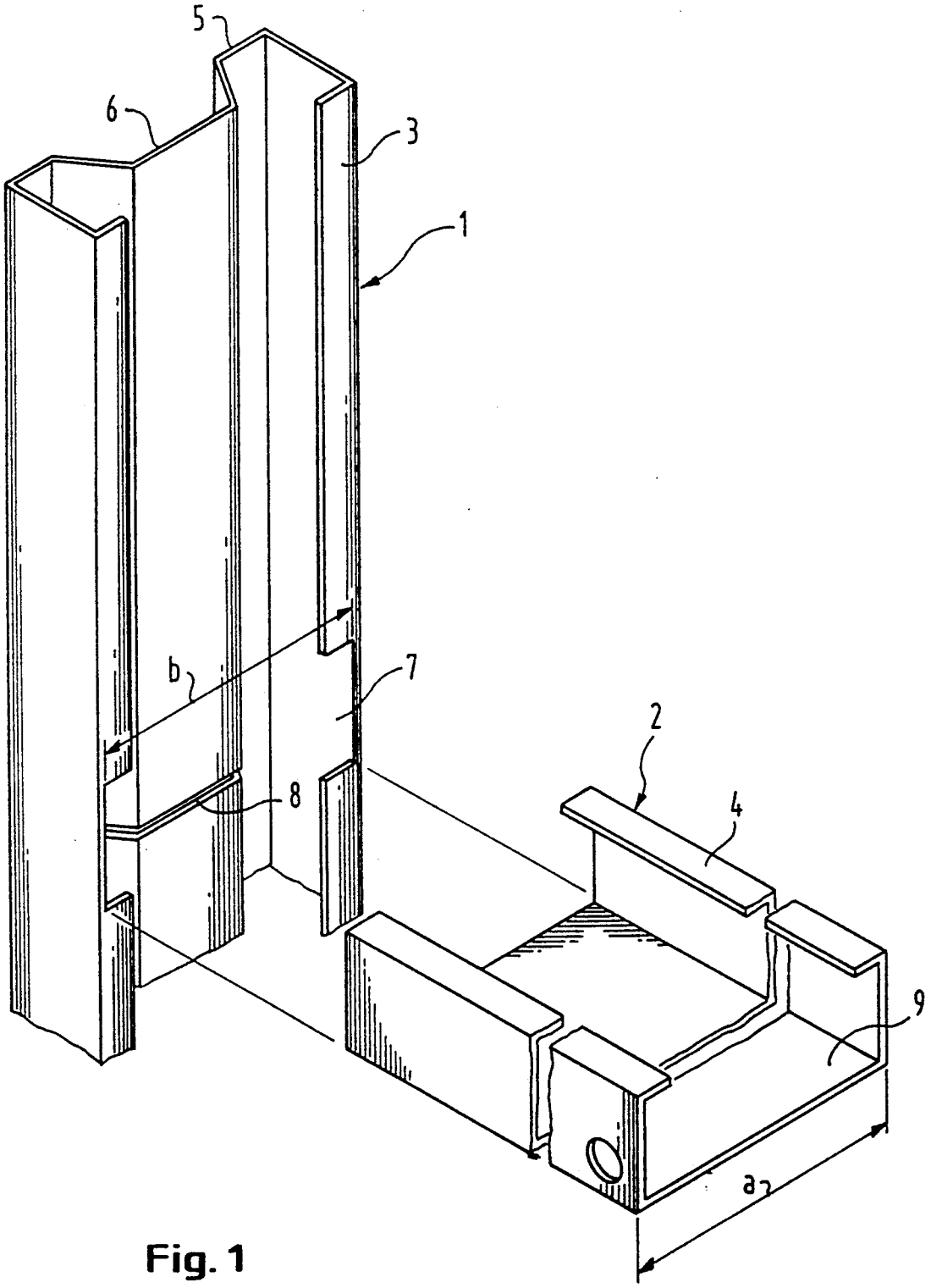
FIG. 1 is a perspective view of longitudinal and transverse sectional beams adapted to be plugged together for making an installation module according to the invention.

An installation module according to the invention includes a support structure of plugged longitudinal and transverse profiled sections, conveniently of two lateral sectional supports 1 (only one being shown in FIG. 1) defining the sides of the installation module. They are interconnected in the area of the bottom of the installation module by a plugged-in transverse profiled section 2. Both the side supports 1 and the transverse profiled section 2 are U-shaped in cross section and have side walls 3 and 4, respectively, which are bent inwardly at an angle to form flanges 3*a* and 4*a*. In the bottom wall 5 of the lateral supports 1 an inward bay 6 is formed which presents a mortar application joint in the finished installation module. The outer dimension a of the transverse profiled section 2 is a little less than the inner dimension b of the lateral supports 1 so that the transverse profiled section 2 with its side walls 4 can be slid between the side walls 3 of the lateral supports 1. Recesses 7 for free passage of the side walls 4 of the transverse profiled section 2 for instance are punched out in the area of the flanges. A slit 8 is incorporated in the bay 6 of the lateral supports 1 at the level of the lower edge of the recesses 7 to receive the bottom wall 9 of the transverse profiled section 2 inserted in the same.

Thanks to the sectioning described and recesses/slits incorporated, the lateral supports 1 are connected in form lock and substantially with stiff angles to the plugged- in transverse profiled section 2. High forces (up to 400 kg) thus can be transmitted between the transverse profiled section 2 and the lateral supports 1.

The sectional frame thus constituted is universally useful for different situations of installation—immurement, building into lightweight walls, antewall installation, and for different types of modules. The longitudinal and transverse sectional beams are adaptable in length and width to the respective type of module. The beams can be provided with the connections required for a particular application, such as by punching out or stamping.

Figure 2:
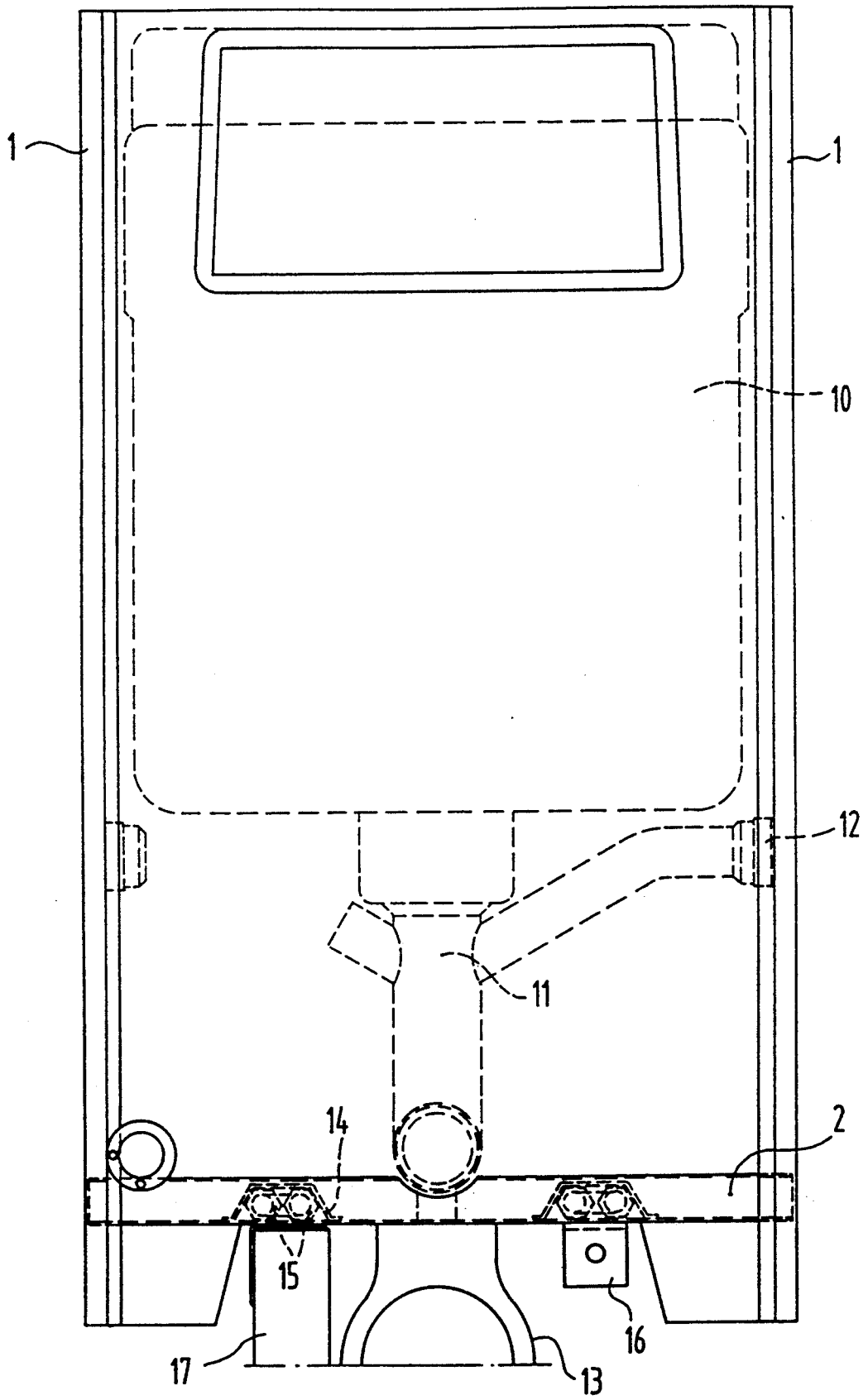
FIG. 2 is the front elevational view of a water closet installation module according to the invention.
Figure 3:
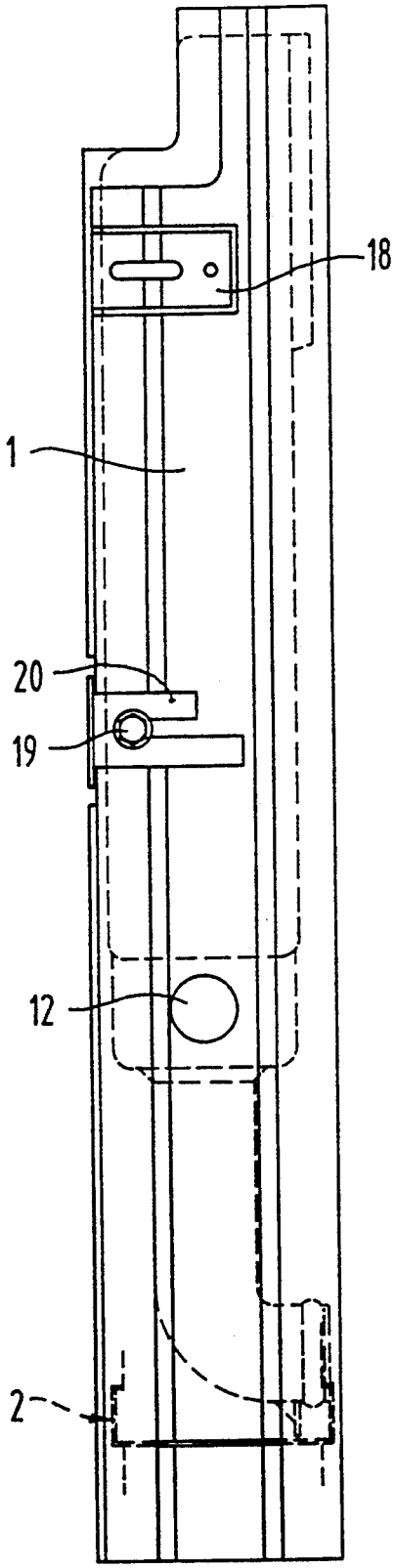
FIG. 3 is the side elevational view of the installation module shown in FIG. 2, but with different connections.

FIGS. 2 and 3 show the sectional frame described as used with a water closet installation module. A flush tank 10 with flushing pipe elbow 11 and vent connection 12 are fixed within the sectional frame. The transverse profiled section 2 is formed with recesses for snap engagement of the pipe hanger 13 of the draining pipe elbow (not shown). Two nut casings 14 with two loosely introduced threaded nuts 15 which are secured against rotation are positioned in the transverse profiled section 2 for hooking up of a water closet. Threaded bolts (not shown) can be screwed into the threaded nuts 15 to suspend the water closet.

As shown in FIG. 2, retaining angles 16 for fastening of an apron covering the foot area, on the one hand, and foot rests 17 for free standing erection of the installation module, on the other hand, can be fixed to the transverse profiled section 2.

Unfolding holding lugs 18 may be stamped into the lateral supports 1, as shown in FIG. 3, for suspending the installation module from a wall. Fastening bolts 19 by which the installation module can be hooked up in a mounting bracket 20 also may be screwable into the lateral supports 1.

The sectional frame equipped in the manner described above is filled with foam conveniently in the usual manner, making use of a foaming mold, with the foamed material having to take over the cohesion of the individual parts but essentially no supporting function. In this manner there is much more freedom than before in selecting the quality of the foamed material and it may be chosen according to other aspects, such as optimum noise or heat insulation.

What is claimed is:

1. An installation module for sanitary equipment, comprising:

a support structure composed of longitudinal and transverse profiled sections in plugged relationship and foamed material by which the longitudinal and transverse profiled sections are held securely together, plumbing components for at least one of supply to and discharge from the sanitary equipment, said plumbing components being embedded in the foamed material, first fastening means attached to the support structure for mounting the installation module, and second fastening means attached to the support structure for attaching the sanitary equipment to the installation module.

2. An installation module according to claim 1, comprising two parallel longitudinal profiled sections at opposite respective sides of the installation module, and at least one transverse profiled section in plugged relationship with each of the two longitudinal profiled sections.

3. An installation module according to claim 2, wherein the module is substantially rectangular and the longitudinal profiled sections extend along opposite respective longitudinal sides of the module, and the transverse profiled section is perpendicular to the longitudinal profiled sections and is located near one end of the module.

4. An installation module according to claim 2, wherein at least one of the longitudinal profiled sections is formed with at least one slot for receiving an end of the transverse profiled section, the configuration of the slot being so related to the profile of the transverse profiled section that when the transverse profiled section is in plugged relationship with said one longitudinal profiled section, relative angular movement of the transverse profiled section and said one longitudinal profiled section is substantially prevented.

5. An installation module according to claim 1, wherein at least a first of the profiled sections is formed with slots for receiving an end of a second of the profiled sections, the configuration of the slots being so related to the profile of the second profiled section that when the second profiled section is receive din the slots of the first profiled section, relative angular movement of the first and second profiled sections is substantially prevented.

6. An installation module according to claim 5, wherein the profiled sections are substantially U-shaped in cross section and each has a bottom wall, two side walls, and inwardly extending flanges.

7. An installation module according to claim 6, wherein the bottom wall of the first profiled section is formed with a depression.

8. An installation module according to claim 7, wherein the first profiled section is formed with slots in the flanges for receiving the side walls of the second profiled section and with a slot in its bottom wall for receiving the bottom wall of the second profiled section.

9. An installation module according to claim 1, comprising two longitudinal profiled sections of equal length and at least one transverse profiled section, and wherein the installation module is substantially rectangular, the length of two parallel sides of the installation module is substantially equal to the length of the longitudinal profiled sections and the length of the other two parallel sides of the installation module is substantially equal to the length of the transverse profiled section.

10. An installation module according to claim 9, wherein the longitudinal and transverse profiled sections are substantially U-shaped in cross section and each has a bottom wall, two side walls, and inwardly extending flanges.

11. An installation module according to claim 10, wherein the bottom wall of each longitudinal profiled section is formed with a depression.

12. An installation module according to claim 1, wherein the first fastening means are attached directly to at least one of said profiled sections.

13. An installation module according to claim 1, wherein the second fastening means are attached directly to at least one of said profiled sections.

14. An installation module according to claim 1, wherein the longitudinal and transverse profiled sections are made of metal.

15. An installation module according to claim 1, wherein the longitudinal and transverse profiled sections are made of synthetic plastic material.

* * * * *